United States Patent [19]

Baumgartner et al.

[11] Patent Number: 4,557,804

[45] Date of Patent: Dec. 10, 1985

[54] COKE COOLER

[75] Inventors: Gary J. Baumgartner, Houston; Carl E. Walter, Kingwood; Arthur J. Post, Jr., Cypress, all of Tex.

[73] Assignee: Triten Corporation, Houston, Tex.

[21] Appl. No.: 611,777

[22] Filed: May 18, 1984

[51] Int. Cl.[4] ..... C10B 39/04; C10B 39/10

[52] U.S. Cl. ..... 202/227; 34/138; 165/88; 165/134.1; 202/229; 202/230

[58] Field of Search ..... 202/227, 228, 229, 230; 165/88, 134 R, 90; 34/138, 109, 9, 15; 432/80; 201/39

[56] References Cited

U.S. PATENT DOCUMENTS

| | | | |
|---|---|---|---|
| 677,870 | 7/1901 | Kittrell | 165/88 |
| 2,840,922 | 7/1958 | Erisman et al. | 34/135 |
| 2,841,883 | 7/1958 | Francis | 34/136 |
| 2,870,547 | 1/1959 | Teichman | 34/129 |
| 2,884,229 | 4/1959 | Francis et al. | 257/81 |
| 2,899,176 | 8/1959 | Francis et al. | 257/86 |
| 3,050,868 | 8/1962 | Erisman et al. | 34/136 |
| 3,078,919 | 2/1963 | Brown, Jr. | 165/142 |
| 3,917,516 | 11/1975 | Waldmann et al. | 202/227 |
| 4,084,546 | 4/1978 | Schneeberger et al. | 122/32 |
| 4,237,362 | 12/1980 | Arnoldy | 219/76.14 |
| 4,237,695 | 12/1980 | Oberpriller et al. | 62/63 |

*Primary Examiner*—Jay H. Woo
*Assistant Examiner*—Joye L. Woodard
*Attorney, Agent, or Firm*—Fulbright & Jaworski

[57] ABSTRACT

A bulk hot coke cooler with a vessel for holding the coolant material and a drum rotatably supported within the vessel so that when the drum rotates, it moves through the coolant, the drum having a plurality of hollow cooling pockets going from one side of the drum to the other which directly contact the hot coke in the drum through which pockets coolant can flow as the drum rotates to enhance the cooling effect of the coolant on the hot coke inside the drum, wear sleeves provided on the edges of selected pockets to protect the lead surfaces of the pockets which come in contact with the hot coke, the wear sleeves being shaped to match the shape of the pocket surface where they are attached, and transfer bars connected to the wear sleeves which move and push the coke through the drum. The various parts of the cooler can be fabricated from hardfaced plate.

9 Claims, 11 Drawing Figures

COKE COOLER

BACKGROUND OF THE INVENTION

1. Field of the Invention

The present invention relates to apparatuses for cooling hot bulk coke by indirect heat exchange with a coolant such as water.

2. Description of the Prior Art

Coke is a porous carbon substance which is a useful by-product of the destructive distillation of coal or petroleum. In the production of coal gas, for example, hot coke is a by-product which must be cooled. A variety of methods and devices are available in the prior art for cooling hot glowing bulk coke discharged during distillation of coal or petroleum. Generally these cooling apparatuses involve a cylindrical drum rotating in a cooling bath, the drum holding the material to be cooled. The drum has means within it or is so mounted that the coke moves from an inlet end, the "hot end," to an outlet end, the "cold end." Temperatures at the hot end may be relatively high, such as 1400° C. while at the cold end relatively low, such as about 65° C.

We are aware of a variety of direct heat exchange devices such as those disclosed in United States Pat. No. 2,840,922; 2,841,883; and 3,050,868; but the prior art indirect heat exchange devices disclosed in U.S. Pat. No. 2,884,229; 2,899,176; and 3,917,516 are the closet prior art to our invention we are aware of. In addition to providing a cooling apparatus, each of the indirect heat exchangers in these references attempts to solve the problems associated with the intense heat encountered in cooling hot bulk material such as coke. None of their solutions is satisfactory.

In U.S. Pat. No. 2,884,229 longitudinally oriented hollow tubes with coolant flowing though them are used for indirect heat exchange. The tubes are shown to be of a consistent diameter, thickness and material composition throughout their length. In order to provide further cooling, a separate scoop is added at the end of each hollow tube to introduce more coolant into the tube. The addition of these scoops is expensive and inefficient and does not serve to reduce the wear of the hollow tubes at the inlet end of the drum due to the high temperature of the hot glowing coke nor do the scoops reduce damage at the outlet end of the tubes caused by the cooled coke which has hardened and so is highly abrasive.

In U.S. Pat. No. 2,899,176 crescent-shaped hollow "flights" are employed as the indirect heat exchange elements. The flights are disposed through the rotating drum. Coolant flows through the flights and hot coke in the interior of the drum is contacted by the cooled interior surface of the flights. The flights are disclosed as having consistent thickness and dimensions throughout. The flights also are positioned so that they act as a internal conveying screw for the hot coke to move it from the hot end to the cold end of the drum. In order to provide an increase in heat exchange capability, each flight has an adjustable orifice which can be opened to permit more coolant to flow through the flight or to permit the coolant to flow more quickly through the flight. This adjustability feature, however, is not satisfactory for reducing the wear on the flights at the hot end of the cooler due to the high inlet temperature; nor does this adjustability feature have a salutary effect on the flights at the cold end of the cooler which are worn down by the abrasive action of the coke.

The cooler of U.S. Pat. No. 3,917,516 uses a plurality of cooling pockets as indirect heat exchange devices. Although this patent recognizes the problems associated with the substantial temperature differentials between both the exterior and interior of the rotating drum and the hot end and cold end of the drum, as well as the wearing problems of the pockets themselves, its solution of simply increasing material thickness in selected areas has not solved these problems in a satisfactory and practical manner.

The solution of U.S. Pat. No. 3,917,516 includes increasing the wall thickness of the rotating drum at the hot end to better withstand the high inlet temperature and increasing the wall thickness at the outlet end to better withstand the abrasive effect of the cooled coke. The fabrication of such a drum with thickness varying outwardly from an intermediate region to both ends is a significantly more complex and more expensive procedure than the fabrication of drums of other configurations. Also, when even the thickened portions wear out of wear through, a significant amount of downtime is required to replace or rebuild the worn parts, resulting in production losses.

U.S. Pat. No. 3,917,516 also proposes cooling pockets varying in height and width, depending on where they are located in the drum and, to protect the surfaces of the pockets turned towards the axis of the drum, angled metal aprons are attached to the pocket's surface. The pockets are disclosed as being of varying thicknesses depending on relative location in the drum. Since the material composition of the pockets does not vary no matter how thick they are, this approach attempts to solve both high temperature problems and abrasion problems by using more and more of the same material without regard for its suitability for solving one problem or the other.

SUMMARY OF THE PRESENT INVENTION

The present invention teaches both new structure and the use of special materials not heretofore used as structural materials in coke coolers for combating abrasion and high temperature. The present invention is directed to a coke cooling apparatus having a drum rotatably mounted in a coolant-containing vessel. The coke to be cooled is introduced at the inlet or hot end of the drum and as the drum rotates through the coolant, means are provided in the interior of the drum for moving the coke to the outlet or cold end. Within the drum itself further indirect heat exchange is provided by a plurality of hollow tubes or pockets through which coolant flows as the drum is rotated. Segmented contoured wear sleeves are provided for the surfaces of the pockets to increase both wearability and heat exchangeability. Sleeves with efficient single-point attachment can be used in chosen areas. Surfaces of the drum and of the pockets can be formed of hardfacing material to resist high temperatures and abrasion. Transfer bars can be connected to the pockets to facilitate the movement of the coke through the drum.

The are various prior art welding apparatuses and methods for applying corrosion resistant alloys, claddings and "hardfacings" to plates. "Hardfacing" is the method of providing an abrasion resistant object that has a desired pattern of random cracks extending through it. There are several method of hardfacing and they incorporate various welding techniques for welding the hardfacing materials to objects. The conventional methods and apparatuses for producing welded hardfaced objects or plates includes methods such as described in U.S. Pat. Nos. 3,494,749; 3,076,888; 3,060,307; and 4,237,362.

The solution to the problems of heat damage and abrasion damage in a coke cooler proposed by the present invention is a radical departure from the prior art solutions which follow an unanalyzed "more-is-better" theory and simply make critical parts thicker. Generally, the microstructure of the metals in prior art coke coolers is not suitable for high abrasion applications. The present invention teaches alterations in the basic microstructure of the metals themselves from which the parts are made and provides for the use of hardfaced plate materials which are specifically chosen to combat high abrasion problems or high heat problems.

It is therefore an object of the present invention to provide an improved hot coke cooler.

It is a further object of the present invention to provide an improved cooler for hot coke which employs indirect heat exchange elements to effect cooling.

Another object of the present invention is the provision of a coke cooler having a drum rotatably mounted in a coolant-containing vessel, the drum having cooling pockets formed integrally therein so that coolant can pass through the pockets, the pockets presenting heat exchange surface to the hot coke within the drum, the pockets having welded thereto or formed integrally thereof wear sleeves for increasing resistance to abrasion and high temperature.

Yet another object of the present invention is the provision of such a coke cooler in which the wear sleeves are contoured to match the contour of the pocket to enhance heat exchangeability and wearability.

Still a further object of the present invention is the provision of such a coke cooler in which contoured wear sleeves may be attached to the pockets at only one point to permit expansion of the sleeves in all directions and provide for easy removability.

An additional object of the present invention is to provide contoured wear sleeves for the cooling pockets which are segmented to allow for expansion when heated.

Another object of the present invention is the provision of such a coke cooler in which removable hardfaced transfer bars are provided which can be connected to the pockets for facilitating the transfer or movement of the coke through the drum, the transfer bars having a single point connection to the sleeve so that the sleeve-transfer bar structure is removable as a unit.

A particular object of the present invention is the provision of such a coke cooler in which various critical parts of the rotating drum, the cooling pockets, the transfer bars and the wear sleeves are fabricated of hardfaced plate material for increased resistance to abrasion and high temperature and eliminating an unnecessary layer of base metal.

Another object of the present invention is the provision of such a coke cooler in which different hardfacing materials are utilized in different areas of the cooler depending on the conditions encountered and the specific desirable properties of the chosen hardfacing.

BRIEF DESCRIPTION OF THE DRAWINGS

The above and other objects of the present invention, as well as features and advantages of it will become clear to one of ordinary skill in this art when read in conjunction with the following drawings in which.

DESCRIPTION OF PREFERRED EMBODIMENTS

For the purposes of disclosure, we will describe the embodiments of our invention preferred at the time of filing our application for patent.

Figure 1:
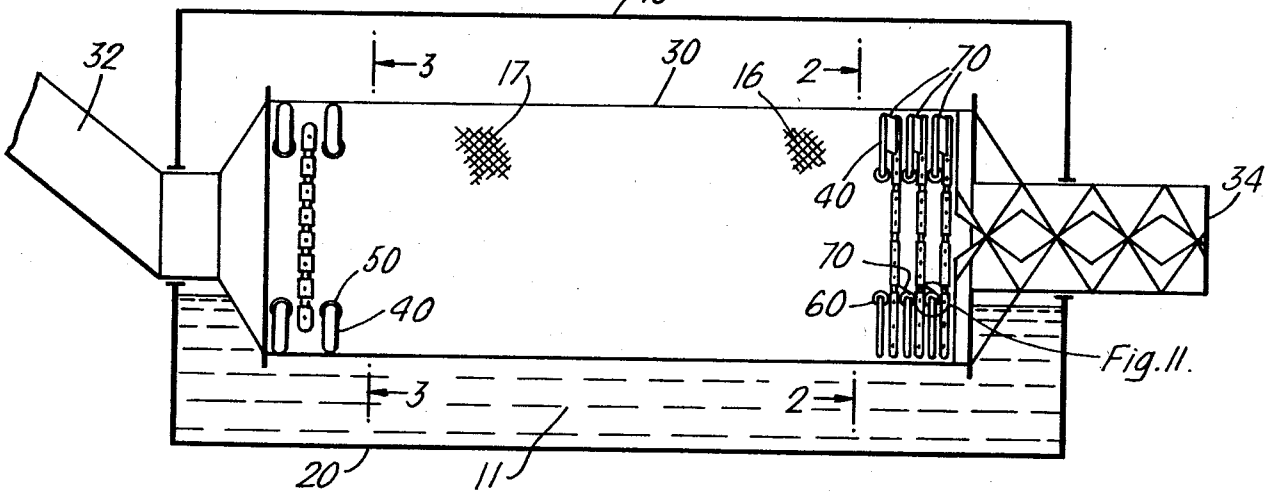
FIG. 1 is a side elevation cut-away view of a coke cooler according to the present invention.

As shown in FIG. 1, the coke cooler 10 includes the vessel 20 which contains coolant, such as water 11. The drum 30 is rotatably mounted in the vessel 20 so that upon rotation the drum 30 moves through the coolant 11. The drum 30 has the inlet duct 32 for the introduction of the hot bulk coke into the drum 30 and the outlet duct 34 for removal of the coke from the drum 30.

Conventional prior art means can be employed within the drum for insuring that the coke moves from the inlet 32 or hot end to the outlet 34 or cold end.

Figure 2:
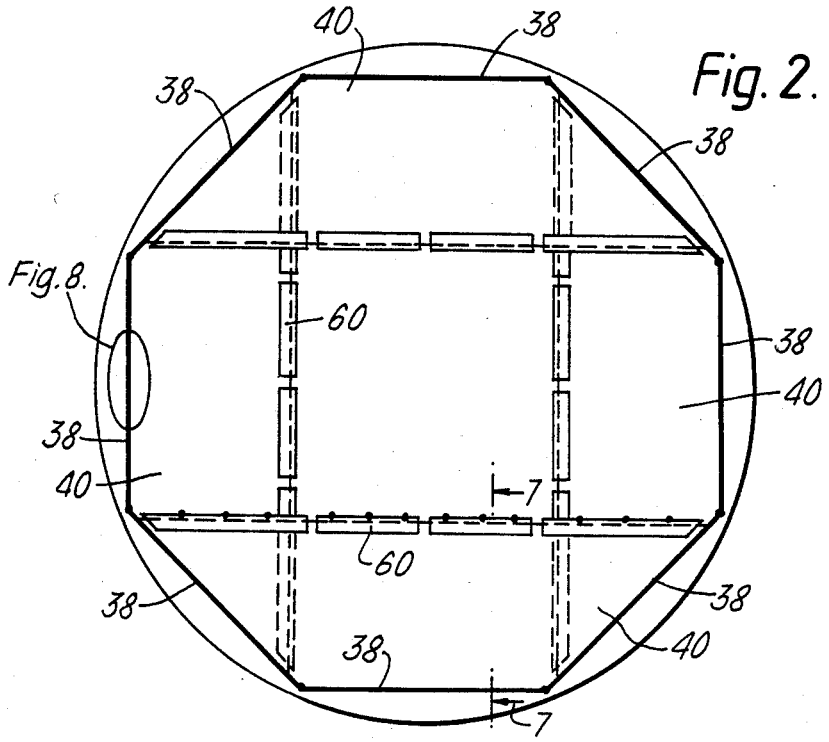
FIG. 2 is a cross-sectional view of the cold end of the cooler taken along line 2—2 of FIG. 1.
Figure 6:
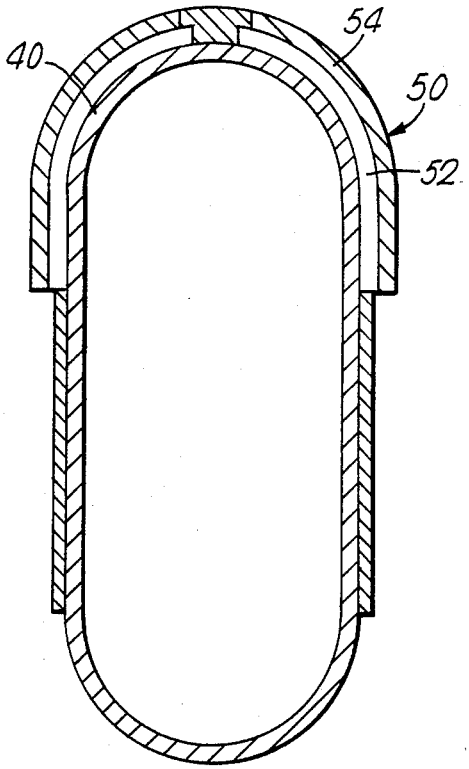
FIG. 6 is a cross-sectional view taken along line 6—6 of FIG. 3.

As shown in FIG. 1 and FIG. 2, the hollow pockets 40 are provided in the drum 30 for enhancing the heat exchangeability of the drum 30. Contoured wear sleeves 50 in the hot end and 60 in the cold end as shown in FIGS. 1, 2, 3, 6, and 7 are provided for the pockets. The wear sleeve 50, for example, as shown in FIG. 6 is formed so that the shape of its interior surface matches the exterior surface of the pocket 40. By insuring that the shaped match, heat transfer between the coke, sleeve, pocket, and coolant is enchanced, unlike the prior art in which the aprons or angle irons attached to the pockets contact the pocket's surface only intermittently. Also, the contoured surface of the wear sleeves according to the present invention insures a more consistent wearing across the entire sleeve as compared to the uneven wearing of the prominent points of the aprons and angle irons of the prior art devices as compared to their other parts.

Figure 3:
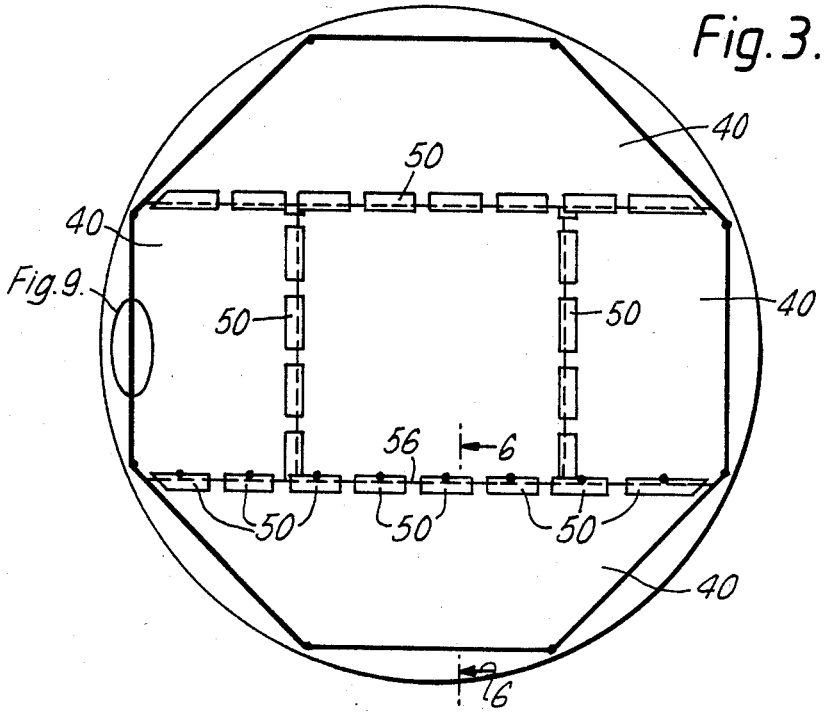
FIG. 3 is a cross-sectional view of the hot end of the cooler taken along line 3—3 of FIG. 1.
Figure 4:
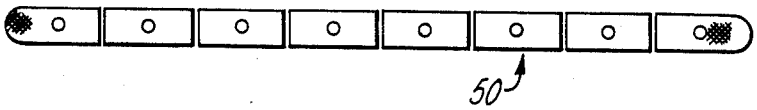
FIG. 4 is an end view of a sleeve at the hot end of the cooler.
Figure 5:
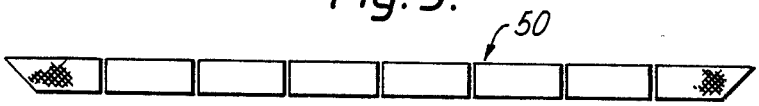
FIG. 5 is a side elevation view of the sleeve of FIG. 4.

As shown in FIGS. 3 and 4, the wear sleeves 50 can be attached at a single point to allow for ease of installation, expansion during operation, and easy removal. Spaces 56 are provided between the sleeves 50 to permit expansion when needed.

Figure 10:
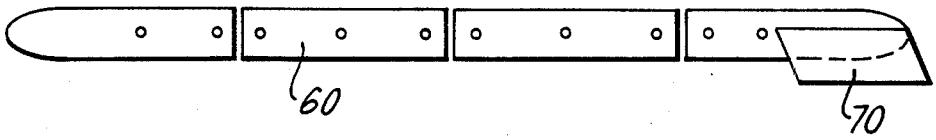
FIG. 10 is a head-on end view of the sleeves in the cold end of the cooler showing the transfer bar on the sleeve.
Figure 11:
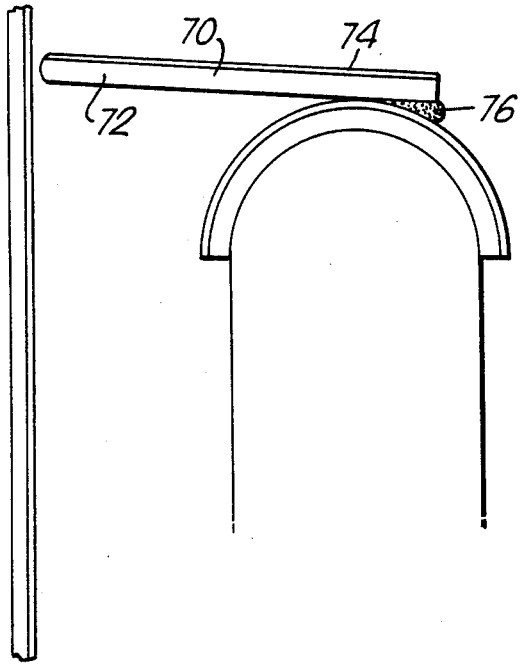
FIG. 11 is a partial cross-sectional view of the detail of FIG. 1 showing a transfer bar, sleeve, and pocket and the single line weld connecting the bar to the sleeve.

As shown in FIGS. 10 and 11, transfer bars 70 are provided on the end of the wear sleeves at locations in the cooler as required by a specific application. The transfer bars contact and push the coke forward thereby facilitating the movement of the coke through the cooler.

The use of transfer bars permanently affixed to both the pockets and the drum is old in this art. Since the prior art bars were attached to the pockets and to the drum, it was a major undertaking to remove and replace a worn or damaged bar, sleeve, or pocket. The present invention teaches both a new structure and a new use of hardfaced plate material for the transfer bars. As shown in FIG. 11, the transfer bar 70 is attached to the sleeve only by welding which permits removal for repair or replacement by removing the sleeve-transfer-bar unit. The transfer bars approach but are not welded to the drum wall. Hardfaced plate material as shown in FIG. 11 is cut to the desired dimensions to form the transfer bars 70. The plate has a base metal layer 72 and a hardfacing layer 74. A line weld 76 connects the bar to the sleeve. The materail used is chosen by taking into consideration the relative location of the pocket and sleeve in the cooler and the particular heat and abrasion conditions encountered at that location. The angle of orientation of the transfer bars 70 with respect to the sleeves and the dimensions of the bars themselves can be varied to meet desired process conditions.

Hardfaced plate can be used for both resistance to abrasion and resistance to abrasion in conjunction with high temperature. By using various hardfaced plate materials the critical parts of the drum 30, the pockets 40 and the sleeves 50, the transfer bars 70, can be fabricated of hardfaced plate itself to accommodate the specific conditions encountered in a specific location in the cooler. By accurately selecting the appropriate materials for the base metal and for the hardfacing, the problems and expense associated with simply increasing the metal wall thickness can be avoided and the problems of abrasion and of abrasion in conjunction with high temperature can be overcome. Although the initial expense of using such materials may be greater than that related to prior art devices, in the long run the use of these materials pays for itself in decreased downtime, decreased replacement expense, and increased production. For example, as shown in FIG. 6, a wear sleeve 50 according to our invention in the hot end of the drum 30 is comprised of a base metal portion 52 which is adapted for use in such a high temperature area, a base metal such as type 304 stainless steel, type 410 stainless steel, or low alloy carbon steel. Also, hardfacing material 54 is used which is particularly suited for high temperature uses, such as commercially available Triten T200X chromium carbide hardfacing, Triten T230 nickel base hardfacing or Triten T6 cobalt base hardfacing.

Figure 7:
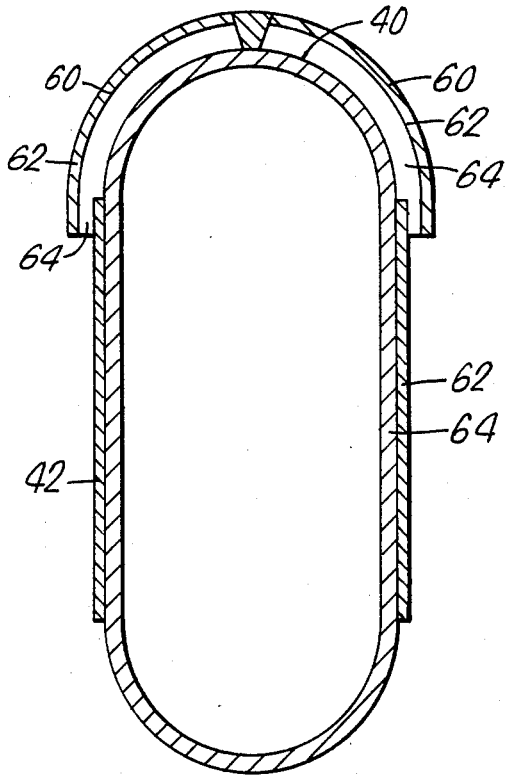
FIG. 7 is a cross-sectional view taken along line 7—7 of FIG. 2.

As shown in FIG. 7 a segmented wear sleeve 60 at the cold end of the drum 30 is formed from a plate with a base metal 64 suited for relatively low temperature, suchas mild carbon steel and with a hardfacing 62 suitable for providing high abrasion resistance, such as chromium carbide hardfacing, nickel-based hardfacing, or cobalt-based hardfacing. Also as shown in FIG. 7, the walls 42 of the pockets 40 themselves can be formed of suitable base metal and hardfacing materials.

Figure 8:
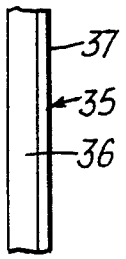
FIG. 8 is a more detailed view of the cross-section of the hardfaced plate of the wall of the drum of FIG. 2.
Figure 9:
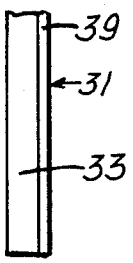
FIG. 9 is a more detailed view of the cross-section of the wall of the drum of FIG. 3.

FIGS. 8 and 9 illustrate the selection of appropriate base metals and hardfacings for the wall of the drum 30. In FIG. 8 the plate 35 is composed of the desired base metal 36 and the desired hardfacing 37. In FIG. 8 the plate 31 is composed of the desired base metal 33 and the desired hardfacing 39.

As shown in FIGS. 2 and 3 the drum is fabricated by welding eight hardfaced plates 38 together, one to the other, rather than by the conventional method of forming the durm from two semicircular pieces of base metal such as carbon steel and welding the two resulting seams. By fabricating the drum from hardfaced plates originally one layer of base metal is eliminated, i.e., the carbon steel base metal layer in the conventional drum, since the hardface plate has its own base metal layer. Also, by originally utilizing a hardfaced plate composed of both a base metal layer and a hardfacing layer, the fabrication process is greatly simplified since the steps required to attach the hardfaced plate to the base metal drum are eliminated. Similarly prior art cooling pockets were formed of two pieces of steel base metal. The pockets 40 of the present invention can be formed completely of hardfaced plates by utilizing flat plates for the side walls and semicircular plate for the end walls.

What is claimed is:

1. A bulk coke cooler comprising a vessel containing coolant, a drum rotatable about a horizontal axis in the vessel while partially submerged in the coolant, the drum having an inlet at one end for receiving the hot bulk coke and an outlet at the other end through which the coke is discharged, the side wall of the drum having substantially the same thickness throughout, a plurality of hollow cooling pockets formed in the wall of the drum so that as the drum rotates through the coolant, coolant enters and leaves the pockets, and at least contoured wear sleeve connected to at least one of the plurality of hollow cooling pockets on the pocket surface turned toward the axis of the drum, the contour of the interior surface of the wear sleeve corresponding to the contour of the surface of the pocket for a match fit so that substantially all of the interior surface of the sleeve contacts the surface of the pocket, the at least one wear sleeve made of hardfaced plate.

2. The bulk coke cooler of claim 1 wherein the at least one wear sleeve is connected to the corresponding pocket by welding the one to the other in a single location.

3. The bulk coke cooler of claim 1 wherein the at least one contoured wear sleeve is comprised of segments which are spaced apart on the pocket surface to allow for expansion upon heating.

4. The bulk coke cooler of claim 1 including also at least one transfer bar connected for easy detachability to at least one of the wear sleeves without contacting a wall of the vessel, a pocket, or any sleeve other than the one to which it is connected, the transfer bar connected to the sleeve at an angle for facilitating the movement of the coke through the cooler.

5. The bulk coke cooler of claim 5 wherein the at least one transfer bar is made of hardfaced plate.

6. The bulk coke cooler of claim 1 wherein the drum is made substantially of hardfaced plate.

7. The bulk coke cooler of claim 1 wherein the hollow cooling pockets are made substantially of hardfaced plate.

8. The bulk coke cooler of claim 1 wherein the inlet end of the drum is made substantially of hardfaced plate which is particularly suited for use in a high temperature environment.

9. The bulk coke cooler of claim 1 wherein the outlet end of the drum is made substantially of hardfaced plate which is particularly suited for withstanding abrasion.

* * * * *

UNITED STATES PATENT OFFICE
CERTIFICATE OF CORRECTION

PATENT NO. : 4,557,804

DATED : December 10, 1985

INVENTOR(S) : Gary J. Baumgartner, et al.

It is certified that error appears in the above-identified patent and that said Letters Patent are hereby corrected as shown below:

Column 2, line 18, change "thickness" to -- thicknesses --
Column 2, line 23, delete the first occurrence of "of" and insert -- or --
Column 2, line 29, change "pockets" to -- pocket --
Column 2, line 62, delete "The" and insert -- There --
Column 2, line 67, change "method" to -- methods --
Column 3, line 3, change "includes" to -- include --
Column 4, line 52, change "shaped" to -- shapes --
Column 4, line 55, change "pocket's" to -- pockets' --
Column 5, line 19, change "materail" to -- material --
Column 6, line 2, change "durm" to -- drum --
Column 6, line 31, after the first occurrence of "least" insert -- one --
Column 6, line 55, claim 5, change "5" to -- 4 --

Signed and Sealed this

First Day of September, 1987

*Attest:*

*Attesting Officer*

DONALD J. QUIGG

*Commissioner of Patents and Trademarks*